US006390863B1

(12) United States Patent
Imanaga

(10) Patent No.: US 6,390,863 B1
(45) Date of Patent: May 21, 2002

(54) OUTBOARD MOTOR

(75) Inventor: Keiji Imanaga, Shizuoka-ken (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/573,937

(22) Filed: May 19, 2000

(30) Foreign Application Priority Data

May 21, 1999 (JP) ..... 11-142140
May 9, 2000 (JP) ..... 2000-136285

(51) Int. Cl.[7] ..... B63H 1/15
(52) U.S. Cl. ..... 440/53; 440/52
(58) Field of Search ..... 440/53, 52, 900, 440/76

(56) References Cited

U.S. PATENT DOCUMENTS 3,062,173 A * 11/1962 Kiekhaefer ..... 440/52
3,310,021 A * 3/1967 Shimanckas ..... 440/52

* cited by examiner

*Primary Examiner*—Ed Swinehart
(74) *Attorney, Agent, or Firm*—Oblon, Spivak, McClelland, Maier & Neustadt, P.C.

(57) ABSTRACT

An outboard motor which include an engine holder, an engine disposed above the engine holder in a state wherein the outboard motor is mounted to a hull, a mount unit including upper and lower mount devices for mounting the outboard motor to the hull and a bracket through which the upper and lower mount devices are mounted to the hull, an elastic thrust stopper disposed between the bracket and a body of the outboard motor, and a propeller driven in accordance with the engine operation. In such outboard motor, the distance between an axis of the upper mount device and an axis of the elastic thrust stopper both extending in a direction parallel to an axis of the propeller is set to be larger than a distance between axes of the upper and lower mount devices which extend in a direction parallel to the axis of the propeller.

5 Claims, 4 Drawing Sheets

OUTBOARD MOTOR

BACKGROUND OF THE INVENTION

1. Field of the Invention

The present invention relates to an outboard motor provided with an improved mount structure for mounting the outboard motor to a hull, for example.

2. Discussion of the Background

FIG. 4 shows one example of an outboard motor 1 which is generally mounted to a hull H (transom) through a bracket 6, to which support members such as upper and lower mount devices 20 and 21 are mounted at vertically two portions in an installed state of the outboard motor to the hull.

Usually, when an engine 3 of the outboard motor is fully driven, the mount devices 20 and 21 may be displaced because of, for example, vibration of the engine 3 and such displacement is restricted by interposing a thrust stopper 23, as another support member, made of an elastic material such as rubber between the body (casing) of the outboard motor 1 and the bracket 6. The thrust stopper 23 is arranged at a level substantially equal to that of the lower mount 21 in a conventional structure.

With reference to FIG. 4, a load applied to the upper and lower two mount devices 20 and 21 will be expressed by the following equations.

$$F2_{pri}(\text{load applied to the lower mount device } 21)=\{(L1+L2)/L2\}\times F1_{pri}$$

$$F3_{pri}(\text{load applied to the upper mount device } 20)=L1\times F1_{pri}/L2=F1_{pri}-F2_{pri}$$

wherein $F1_{pri}$ is a propelling force of a propeller 13, L1 is a distance between an axis of the propeller 13 and an axis of the lower mount device 21 and L2 is a distance between the axes of the upper and lower mount devices 20 and 21.

Incidentally, in a two-stroke-cycle two-cylinder engine or four-stroke-cycle three- or five-cylinder engine, an inertia couple of force is generated about a center of a crankshaft 4 of the engine and the inertia couple of force generates a vibration about a center of gravity C/G of the engine 3. In the outboard motor 1, as shown in FIG. 4, the center of gravity C/G is generally positioned at a portion near the upper mount device 20 disposed at an upper position of the central portion of the entire structure of the outboard motor 1. Further, in the outboard motor 1, primary and secondary vibrations or like of the engine 3 other than the vibration due to the inertia couple of force mentioned above are generated in a complicated manner, thus providing a problem.

A thrust stopper 23 is disposed for the purpose of preventing an excessive deviation of the lower mount device 21 and arranged in a level substantially equal to the lower mount device 21. When the lower mount device 21 is arranged at a lower position, it supports the engine 3 at a position apart from the center of gravity C/G of the engine 3, and hence, it is difficult to absorb the vibration of the engine 3 due to the inertia couple of force mentioned above.

In such a positional arrangement, when the lower mount device 21 is located at a high position, the load $F_{pri}$ applied to the upper mount device 20 at the engine full operation time, for example, is made large and it is necessary to construct the upper mount device 20 by using a relatively hard elastic material.

However, in a case when the upper mount device 20 is formed of a relatively hard elastic material, the upper mount device 20 will not sufficiently absorb the complicated primary and secondary vibrations of the engine 3.

SUMMARY OF THE INVENTION

An object of. the present invention is to substantially eliminate defects or drawbacks encountered in the prior art mentioned above and to provide an outboard motor having an improved mount structure capable of effectively reducing the load applied to the mount devices at a time of fully operating the engine of the outboard motor.

This and other objects can be achieved according to the present invention by providing an outboard motor which comprises:

an engine holder;

an engine disposed above the engine holder in a state wherein the outboard motor is mounted to a hull;

a mount unit including upper and lower mount devices for mounting the outboard motor to the hull and a bracket through which the upper and lower mount devices are mounted to the hull;

an elastic member disposed between the bracket and a body of the outboard motor; and a propeller driven in accordance with the engine operation, wherein the distance between an axis of the upper mount device and an axis of the elastic member both extending in a direction parallel to an axis of the propeller is set to be larger than the distance between axes of the upper and lower mount devices which extend in a direction parallel to the axis of the propeller.

In a preferred embodiment, the elastic member is positioned such that the axis of the elastic member is below the axis of the lower mount device. The bracket is provided with a downward extension, to which the elastic member is provided. The elastic member may be formed as a thrust stopper.

According to the present invention of the characters mentioned above, the distance between an axis of the upper mount device and the axis of the elastic member both extending in the direction parallel to the axis of the propeller is set to be larger than the distance between the axes of the upper and lower mount devices which extend in a direction parallel to the axis of the propeller, so that the load to be applied to the upper mount member can be reduced and the vibration of the entire structure of the outboard motor can be also reduced. Furthermore, these advantageous effects can be further increased according to the arrangement of the preferred embodiment mentioned above.

The nature and further characteristic features of the present invention will be made further clear from the following descriptions made with reference to the accompanying drawings.

DESCRIPTION OF THE PREFERRED EMBODIMENT

Figure 1:
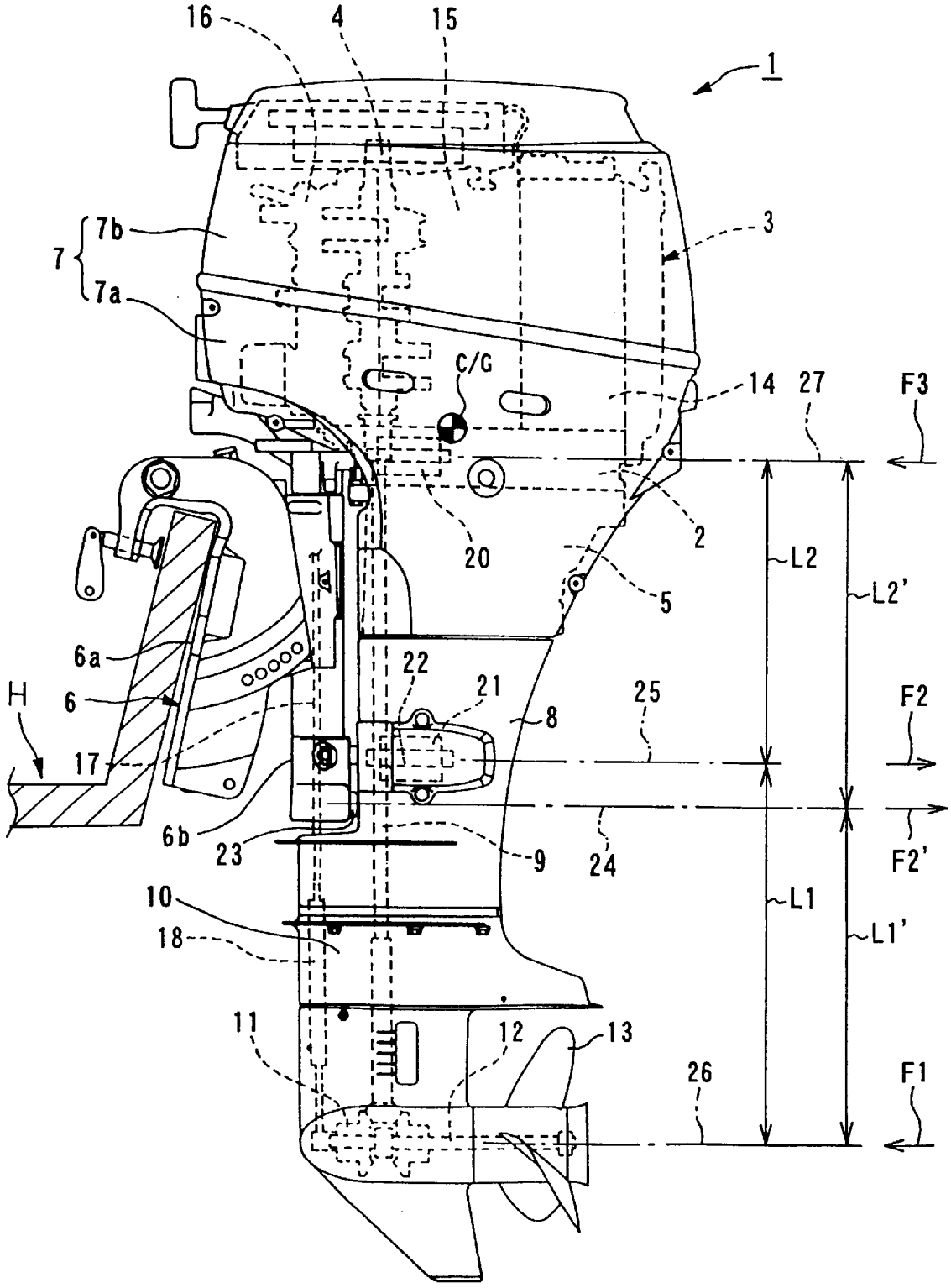
FIG. 1 is a side view of an outboard motor to which mount devices according to the present invention are mounted.
Figure 4:
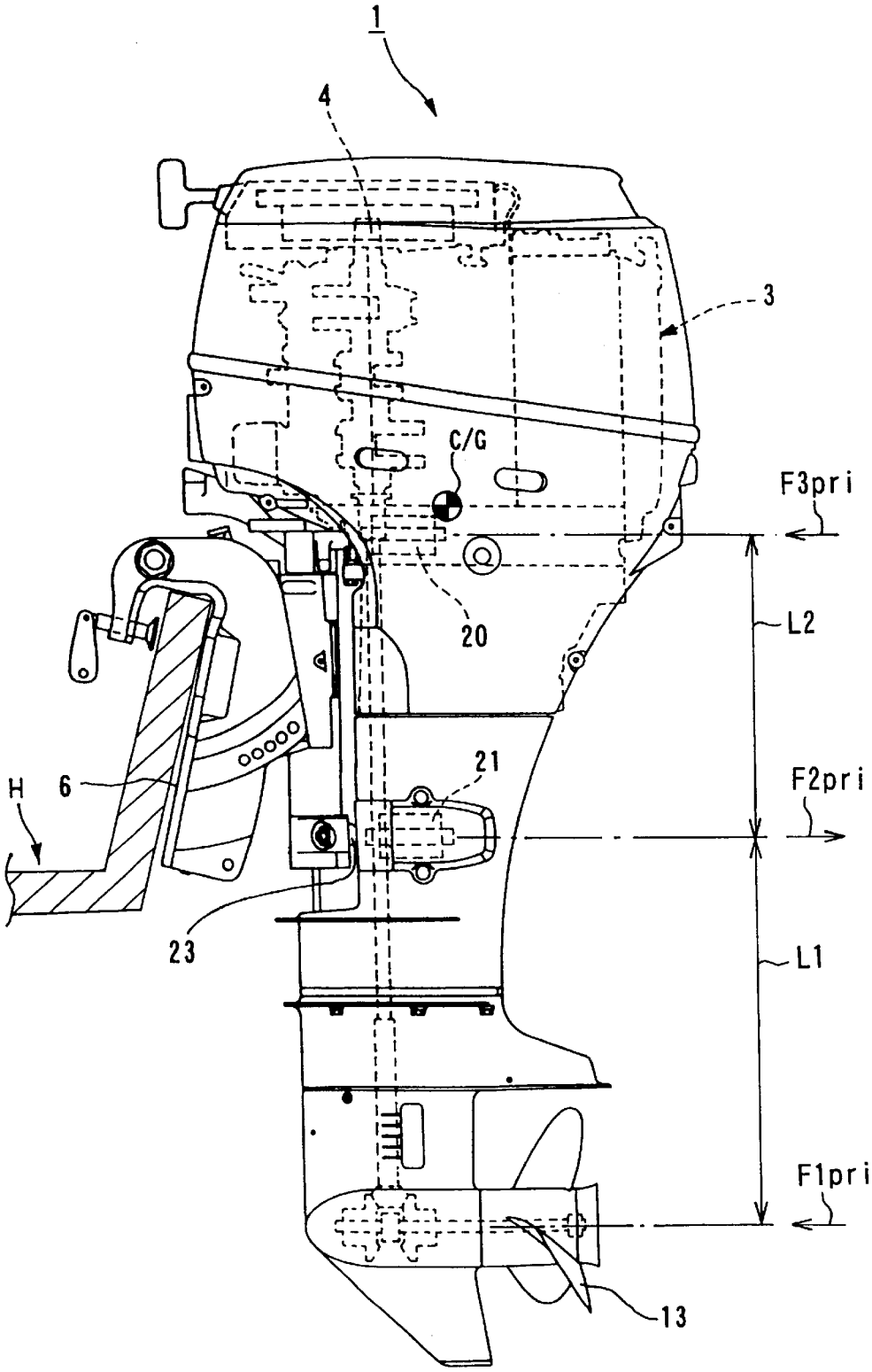
FIG. 4 PRIOR ART
FIG. 4 is a side view of an outboard motor having a conventional structure.

FIG. 1 shows a side view of an outboard motor in a state to be mounted to a hull H (transom) in which like reference numerals are added to members or portions corresponding to those shown in FIG. 4 are added.

With reference to FIG. 1, an outboard motor 1 is equipped with an engine holder 2 and an engine 3 is disposed above the engine holder 2. The engine 3 of the illustrated type has a vertical-type engine in which a crankshaft 4 is perpendicularly arranged, and an oil pan 5 is disposed below the engine holder 2. A bracket 6 is attached to a body of the outboard motor 1, and hence, the outboard motor (or body of the outboard motor) is mounted to the transom of the hull H through the bracket 6.

Outer peripheral portions of the engine 3, the engine holder 2 and the oil pan 5 of the outboard motor 1 are covered by an engine cover 7, which has two splittable vertical sections including a lower cover section 7*a* covering a lower portion of the engine 3, the engine holder 2 and the oil pan 5 and an upper cover section 7*b* covering an upper portion of the engine 3.

A drive shaft housing 8 is arranged below the oil pan 5 and a drive shaft 9 is perpendicularly arranged in the drive shaft housing 8. The drive shaft 9 has an upper end connected to a lower end of the crankshaft 4 and a lower end extending downward in the drive shaft housing 8 and acts to drive a propeller 13 through a bevel gear 11 and a propeller shaft 12 arranged in a gear case 10. Further, it is to be noted that the axis of the propeller 13 accords with the propelling direction thereof (outboard motor or hull).

In the gear case 13, a clutch mechanism 18 is also accommodated for operating the propeller shaft 12 and the propeller 13 via a clutch rod 17 through a remote control so as to shift the rotational direction of the propeller shaft 12 and the propeller 13 to take forward, reverse or neutral position.

The engine 3 mounted to the shown outboard motor 1 is, for example, a water-cooled-cycle three-cylinder engine constructed by assembling a cylinder head 14, a cylinder block 15, a crankcase 16 and so on. The cylinder block 15 is disposed on a rear side, right side as viewed in FIG. 1, of the crankcase 16 which is disposed on the most forward side, left side as viewed, of the engine 3, and the cylinder head 14 is disposed rear side the cylinder block 15.

Figure 2:
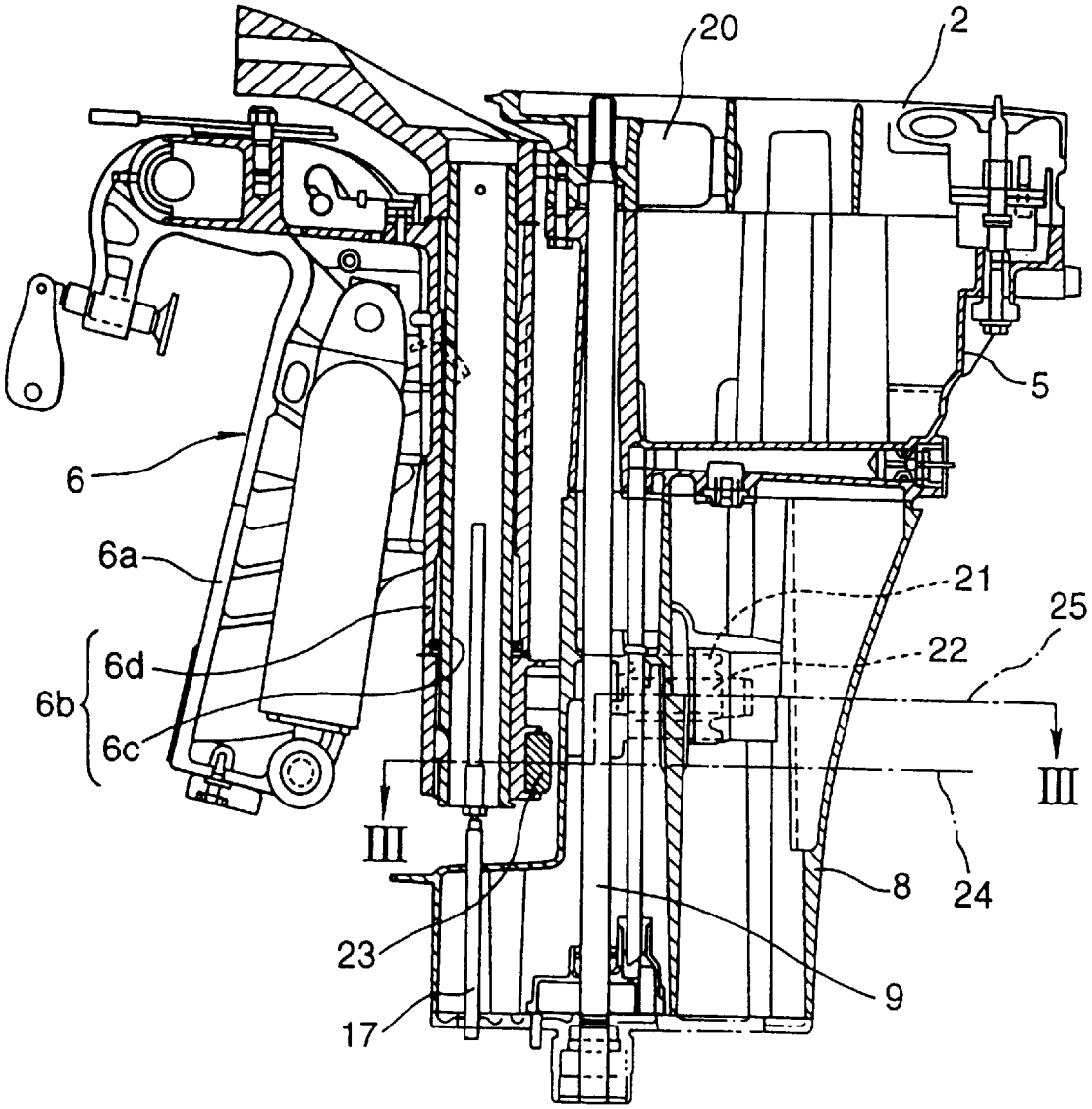
FIG. 2 is an enlarged sectional view of a central portion of the outboard motor of FIG. 1.
Figure 3:
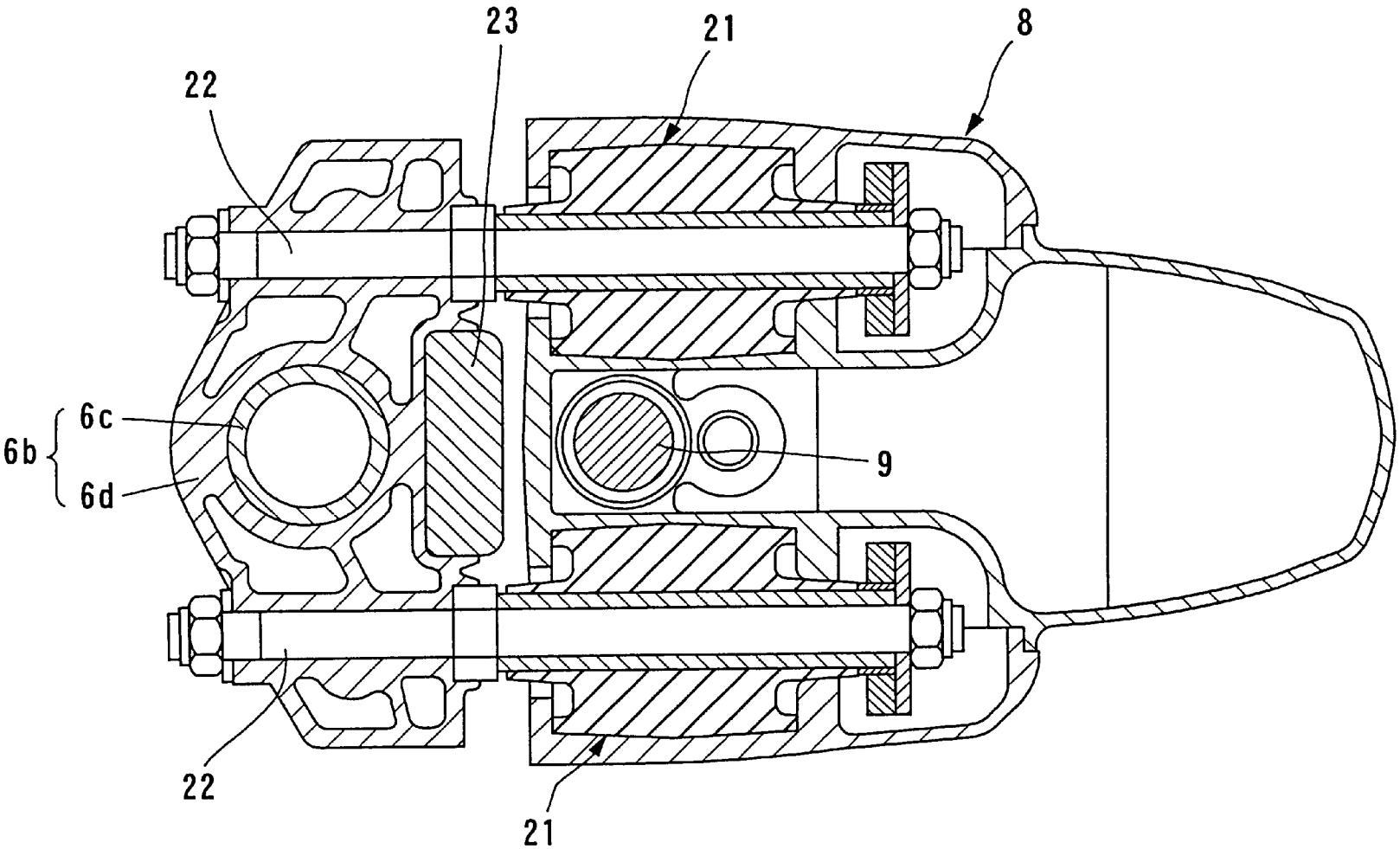
FIG. 3 is a sectional view taken along the line III—III in FIG. 2.

With reference to FIGS. 1 to 3, the bracket 6 comprises a clamp member 6*a* and a swivel member 6*b* having a double-tube structure which is composed of an inner pipe section 6*c* and an outer pipe section 6*d* and in which the clutch rod 17 mentioned above is inserted.

The outer pipe section 6*d* is fixed to the clamp member 6*a* fixed to the hull H and the inner pipe section 6*c* is fixed to the outboard motor side so that the outboard motor 1 is steered in a bilateral direction thereof. The inner pipe section 6*c* is, in this embodiment, mounted to the body of the outboard motor 1 via two mount devices 20 and 21 at vertical two portions thereof. More in detail, although mentioned hereinlater, a mount unit of the present invention comprises upper and lower mount devices 20 and 21 as supporting members and the bracket 6 mounted to the outer portion of the body of the outboard motor 1 through which the outboard motor 1 is mounted to the hull H.

As shown in FIGS. 2 and 3, the upper portion of the swivel member 6*b* is fixed to the bilateral pair of the upper mount devices 20 by means of mount bolts, not shown, and the lower portion of the swivel member 6*b* is, on the other hand, fixed to the bilateral pair of the lower mount devices 21 by means of mount bolts 22, these upper and lower mount devices 20 and 21 acting as upper and lower support members as mentioned before.

An elastic member formed as a thrust stopper 23 having an elastic property is mounted to the lower portion of the swivel member 6*b*. This thrust stopper 23 is a member for restricting a displacement of the lower mount device 21 caused at the fully driven (opened) state of the engine 3, for example. This thrust stopper 23 is fixed to the lower portion of the swivel member 6*b* at a portion between the swivel member 6*b* and the body of the outboard motor 1, that is, drive shaft housing 8, and acts as another support member at the engine fully driven time like the upper and lower mount devices 20 and 21. Further, as shown in FIG. 1, the lower portion of the swivel member 6*b* of the bracket 6 extends downward and the thrust stopper 23 is disposed to this extending portion with a gap.

The thrust stopper 23 is arranged in a manner such that the axis 24 thereof extending parallel to the axis 26 of the propeller 13 is positioned on the side of the propeller 13 in comparison with the axis 25 of the lower mount device 21 also extending parallel to the axis 26 of the propeller 13. As shown in FIG. 1, the thrust stopper 23 and the upper and lower mount devices 20 and 21 have a positional relationship such that a distance L2' between the axis 27 of the upper mount device 21 extending parallel to the axis 26 of the propeller 13 and the axis 24 of the thrust stopper 23 is larger than a distance L2 between the axis 25 of the lower mount device 21 and the axis 27 of the upper mount device 20.

Operation and function of the present embodiment will be described hereunder.

Hereunder, with reference to FIG. 1, an explanation will be made by understanding that a propelling force of the propeller 13 is F1, a load applied to the lower mount device 21 is F2, a load applied to the thrust stopper 23 is F2', a load applied to the upper mount device 20 is F3, a distance between the axis 26 of the propeller 13 and the axis 25 of the lower mount device 21 is L1, and a distance between the axis 26 of the propeller 13 and the axis 24 of the thrust stopper 23 is L1'.

For example, in a state that the engine 3 is operated at a small power setting and the thrust stopper 23 does not abut against the outboard motor 1, i.e., that the propelling force F1 of the propeller 13 is small ($F1=F1a$), a load $F2a'$ applied to the thrust stopper 23 is 0 (zero) and a load $F2a$ applied to the lower mount device 21 is obtained as $F2a=\{(L1+L2)/L2\}\times F1a$, and a load $F3a$ applied to the upper mount device 20 is obtained as $F3a=L1/L2\times F1a=F1a-F2a$.

Furthermore, for example, in a state wherein the engine 3 is operated at a middle power setting and the thrust stopper 23 approaches and abuts against the outboard motor 1, i.e., that the propelling force F1 of the propeller 13 is a middle ($F1=F1b$), a load $F2b'$ applied to the thrust stopper 23 is still 0 (zero) and a load $F2b$ applied to the lower mount device 21 is obtained as $F2b=\{(L1+L2)/L2\}\times F1b$, and a load $F3b$ applied to the upper mount device 20 is obtained as $F3a=L1/L2\times F1b=F1b-F2b$. Further, in a state wherein the thrust stopper 23 abuts against the outboard motor 1, a load is no longer applied to the lower mount device 21, so that the load $F2b$ is constant ($F2_{const}$).

Additionally, for example, in a state wherein the engine 3 is fully operated (full open state) and the propelling force F1 of the propeller 13 is maximum ($F1=F_{max}$), a load $F2c'$ applied to the thrust stopper 23 is obtained as $F2c'=\{(L1'+L2')/L2'\}\times F1_{max}$ and a load applied to the lower mount device $F2c$ is constant ($F2_{const}$). In this state, a load $F3c$ applied to the upper mount device 20 obtained, providing that the thrust stopper 23 is a center of moment, as $F3c=L1'/L2'\times F1_{max}+(L2'-L2)\times F2_{const}$, or, providing that the lower mount device 21 is the center of moment, as $F3c = L1 \times F1_{max}/L2 - (L2' - L2) \times F2c'/L2$.

In a conventional arrangement, the thrust stopper 23 is positioned at substantially the same level as the lower mount device 21, so that the load $F3_{pri}$ applied to the upper mount device 20 at the engine full open state is expressed as $F3_{pri} = L1 \times F1_{max}/L2$. However, according to the arrangement of the present invention, the distance L2' between the axis 27 of the upper mount device 21 and the axis 24 of the thrust stopper 23 is set to be larger than the distance L2 between the axis 25 of the lower mount device 21 and the axis 27 of the upper mount device 20, so that the load F3*c* applied to the upper mount device 20 at the engine full open state is less, providing that the lower mount device 21 is the center of the moment, by an amount of $(L2' - L2) \times F2c'/L2$ in comparison with the conventional load $F3_{pri}$.

According to the above fact that the load F3*c* applied to the upper mount device 20 at the engine full open state is reduced as compared with the conventional arrangement, the vibration of the engine 3 can be sufficiently absorbed by the upper mount device 20, thus reducing the total vibration of the outboard motor 1.

Furthermore, according to the arrangement of the present invention, since the thrust stopper 23 is provided to a lower extension of the swivel member 6*b* of the bracket 6, the axis 24 of the thrust stopper 23 is positioned below the axis 25 of the lower mount device 21, i.e. propeller 13 side, the load applied to the upper mount device 20 can be reduced, thus being advantageous.

It is to be noted that the present invention is not limited to the described embodiment and other changes and modifications may be made without departing from the scopes of the appended claims.

What is claimed is:

1. An outboard motor comprising:

an engine holder;

an engine disposed above the engine holder and being attachable to a hull;

a mount unit including upper and lower mount devices for mounting the outboard motor to the hull at two vertical portions thereof and a bracket through which said upper and lower mount devices are mounted to the hull;

an elastic thrust stopper means disposed between the bracket and a body of the outboard motor; and a propeller driven in accordance with the engine operation, wherein said lower mount device is displaceable by means of said elastic stopper means, and a distance between an axis of the upper mount device and an axis of the elastic means both of which extend in a direction parallel to an axis of the propeller is set to be larger than a distance between axes of the upper and lower mount devices which extend in the direction parallel to the axis of the propeller.

2. An outboard motor according to claim 1, wherein said elastic thrust stopper means is positioned such that the axis of the elastic member is below the axis of the lower mount device.

3. An outboard motor comprising:

an engine holder;

an engine disposed above the engine holder and being attachable to a hull;

a mount unit including upper and lower mount devices for mounting the outboard motor to the hull at vertical two portions thereof and a bracket through which said upper and lower mount devices are mounted to the hull;

elastic thrust stopper means disposed between the bracket and a body of the outboard motor; and a propeller driven in accordance with the engine operation, wherein a distance between an axis of the upper mount device and an axis of the elastic thrust stopper means both of which extend in a direction parallel to an axis of the propeller is set to be larger than a distance between axes of the upper and lower mount devices which extend in the direction parallel to the axis of the propeller, and wherein said bracket is provided with a downward extension, to which said elastic thrust stopper means is provided.

4. An outboard motor according to claim 1, wherein said elastic thrust stopper means comprises thrust stopper means for restricting displacement of the lower mount device during a substantially fully driven state of the engine.

5. An outboard motor according to claim 1, wherein said elastic thrust stopper means has sufficient elasticity for restricting displacement of the lower mount device during a substantially fully driven state of the engine.

* * * * *